US005916377A

United States Patent [19]

Lopez et al.

[11] Patent Number: 5,916,377

[45] Date of Patent: Jun. 29, 1999

[54] PACKED BED CARBURIZATION OF TANTALUM AND TANTALUM ALLOY

[75] Inventors: Peter C. Lopez; Patrick J. Rodriguez, both of Espanola; Ramiro A. Pereyra, Medanales, all of N.M.

[73] Assignee: The Regents of the University of California, Los Alamos, N.M.

[21] Appl. No.: 09/063,327

[22] Filed: Apr. 20, 1998

Related U.S. Application Data

[60] Provisional application No. 60/044,484, Apr. 21, 1997.

[51] Int. Cl.[6] ..... C23C 8/64

[52] U.S. Cl. ..... 148/237; 216/108

[58] Field of Search ..... 148/237; 216/55, 216/100, 108

[56] References Cited

U.S. PATENT DOCUMENTS 5,383,981 1/1995 de Pruneda ..... 148/237

OTHER PUBLICATIONS

Patrick J. Rodriguez, "Characterization and Refinement of Carbide Coating Formation Rates and Dissolution Kinetics in the Ta—C System," Master's Thesis, Department of Mechanical Engineering, The University of New Mexico, Albuquerque NM, describes the carburization process which is the subject of the present invention, Oct. 1996.

*Primary Examiner*—John Sheehan
*Attorney, Agent, or Firm*—Samuel L. Borkowsky

[57] ABSTRACT

Packed bed carburization of a tantalum or tantalum alloy object. A method for producing corrosion-resistant tantalum or tantalum alloy objects is described. The method includes the steps of placing the object in contact with a carburizing pack, heating the packed object in vacuum furnace to a temperature whereby carbon from the pack diffuses into the object forming grains with tantalum carbide along the grain boundaries, and etching the surface of the carburized object. This latter step removes tantalum carbides from the surface of the carburized tantalum object while leaving the tantalum carbide along the grain boundaries.

6 Claims, 2 Drawing Sheets

PACKED BED CARBURIZATION OF TANTALUM AND TANTALUM ALLOY

This application claims the benefit U.S. Provisional Application No. 60/044,484, filed Apr. 21, 1997.

FIELD OF THE INVENTION

The present invention relates generally to carburization of metals and more particularly to a packed bed process for the carburization of tantalum. This invention was made with government support under Contract No. W-7405-ENG-36 awarded by the U.S. Department of Energy to The Regents to the University of California. The U.S. Government has certain rights in the invention.

BACKGROUND OF THE INVENTION

Tantalum is one of the most corrosion-resistant metals known; in most environments, it is almost as inert as gold or platinum. Tantalum's corrosion-resistance can be attributed to the presence of a thin layer of tantalum oxide ($Ta_2O_5$) on the metal surface. In general, tantalum presents a non-wetting surface to most liquids. Tantalum parts used in corrosive environments generally exhibit extended longevity because thermal cycling does not affect its surface finish and corrosion by many conventional liquid metals and salts is minimal. In addition, tantalum can be cold worked and machined.

The majority of tantalum used in this country is by industries employing corrosive chemicals. About one half the tantalum used in the chemical industry is used to process sulfuric acid. Plants use tantalum heating surfaces to reconcentrate sulfuric acid generated from metal pickling, oil refinery operations, and petrochemical processing in the production of alcohols and ketones. Tantalum is also used in the production and handling of hydrochloric acid, hydrobromic acid, and derivatives thereof. Operations involving chlorine or chloride derivatives employ about one-fourth the tantalum used in the chemical industry. Plants employing aqua regia to refine precious metals use tantalum extensively since tantalum is also one of the few metals resistant to aqua regia. Tantalum is widely used in the production of high purity nitric acid and terephthalic acid. Industries that cannot tolerate impurities such as the pharmaceutical and food industries, use tantalum because of its negligible corrosion rate.

Pyrochemical and pyrometallurgical processes for nuclear materials employ tantalum components. Although highly corrosion-resistant, tantalum may not be completely inert in the extremely corrosive environments employed in the processing of various nuclear materials. Failed hardware can lead to the interruption or failure of a procedure which may result in added exposure to radioactive materials. Additionally, degraded or failed components must be discarded as radioactive waste.

Although tantalum crucibles have been used to contain corrosive liquids such as molten plutonium, various problems arise during processing. For example, in column 1, lines 40–53, of U.S. Pat. No. 5,383,981, to Jean A. H. de Pruneda entitled "Reusable Crucible For Containing Corrosive Liquids," which issued Jan. 24, 1995, it is stated that wetting, that is, adhesion, of the molten metal to the surface of the tantalum crucible causes " . . . chemical and mechanical corrosion of the crucible. The corrosive liquid adheres to the crucible surfaces, attacks the grain boundaries of the crucible material, penetrates along the grain boundaries, and eventually detaches grains of the crucible that can dissolve in and contaminate the liquid. The wetting of the crucible by the liquid metal also hinders the removal of the cooled product . . . ".

The corrosion-resistance of a tantalum component can be increased if the component is carburized. However, de Pruneda states in column 1, lines 54–63, that the resultant " . . . surface coatings do not remain bonded to the substrate, however, but are stressed during cooling of the melt. A cooled, solidified material like plutonium, for example, has a thermal expansion coefficient quite different from the container material, which causes the layers of tantalum carbide to fracture and rip off during the cooling and removal of the solid . . . ".

In contrast to the above-mentioned tantalum or surface-carburized tantalum components, the '981 patent teaches a non-wetting, corrosion resistant material comprising a tantalum or tantalum alloy substrate which is supersaturated with carbon. Example 1 of the '981 patent, column 4, line 51, through column 6, line 5, describes a procedure for making a carburized tantalum crucible. Assuming a parabolic growth rate and an Arrhenius temperature dependence, the mass of carbon needed to saturate the crucible with carbon is calculated. The thickness of TaC and $Ta_2C$ layers having this mass of carbon is calculated. A thin-walled (0.287 cm) crucible is heated in methane at 1600° C. for 3–4 hours until layers of TaC and $Ta_2C$ of the chosen thicknesses are formed. The crucible is then "heat soaked" under a vacuum for 15–20 hours to allow the carbon present in the surface carbide layers of the crucible to diffuse into the crucible. It is important not to grow TaC and $Ta_2C$ layers having thicknesses in excess of the calculated thickness because an undesirable surface tantalum carbide layer would remain after the heat soaking procedure.

The carbon-saturated tantalum material disclosed in the '981 patent is said to have non-wetting properties superior to either tantalum or surface carburized tantalum. Also, in column 4, lines 1–4, it is stated that alternative carbon sources such as solid carbon or acetylene gas can be used.

The process described in the '981 patent requires about 1 day of heating at 1700° C. to carburize a thin-walled crucible. It may be desirable to reduce cost by shortening heating time. Although elimination of the heat soak step of the '981 patent would shorten processing time, the tantalum crucible, after carburizing and prior to heat soaking, has carbide coatings that must be removed before using it to contain corrosive liquids.

Therefore, an object of the present invention is to provide a process for carburizing objects of tantalum or tantalum alloy having increased corrosion resistance.

Another object of the invention is to provide a process for making reusable carburized objects of tantalum or tantalum alloy having a non-wetting surface.

A further object of the present invention is to provide a process for carburizing objects of tantalum or tantalum alloy using a non-flammable carbon source.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the objects and purposes of the present invention as embodied and broadly described herein, the process for the carburization of an object of tantalum or tantalum alloy of the present invention includes the steps of placing at least one surface of the object in contact with a carburizing pack, evacuating the volume around the packed object, heating the object and the carburizing pack to a temperature whereby carbon from the pack diffuses into the object forming grains with tantalum carbide along the grain boundaries, and etching the surface of the carburized object, thereby removing tantalum carbides from the surface of the carburized object and leaving the tantalum carbide along the grain boundaries.

BRIEF DESCRIPTION OF THE DRAWINGS

The accompanying drawings, which are incorporated in and form a part of the specification, illustrate embodiments of the present invention and, together with the description, serve to explain the principles of the invention. In the figures.

DETAILED DESCRIPTION OF THE INVENTION

Briefly, the present invention includes a method for carburizing tantalum and tantalum alloy articles. A tantalum crucible and a tantalum alloy crucible were used to demonstrate the present invention. The tantalum alloy consisted of 90% tantalum and 10% tungsten. The carbon source used to carburize the tantalum and tantalum alloy crucibles was premium-grade activated carbon powder having particulate sizes such that 90% of the particles pass through a 100 mesh screen and 60% of the particles pass through a 325 mesh screen may be used with the present invention. Smaller or larger particle sizes may also be used without any substantial difference. Prior to use, the powder was heated under a vacuum in a vacuum furnace to remove volatile substances. The carbon powder and tantalum or tantalum alloy crucible are contained in a crucible having a cover. Preferably, a graphite crucible and graphite cover are used to contain the carbon powder and the tantalum or tantalum alloy crucible. The graphite cover did not make an air-tight seal with the graphite crucible, but was necessary to prevent loss of carbon powder especially during evacuation of the vacuum furnace used prior to heating.

The surface of the tantalum or tantalum alloy crucible was first rubbed with 400 grit sandpaper and rinsed with an organic solvent such as ethyl alcohol or acetone. The rubbing and rinsing procedure provided a uniformly clean surface. The tantalum crucible was then placed in the graphite crucible, packed with the carbon powder, and covered with the graphite cover. The furnace was evacuated and flushed with argon gas for 3 cycles in order to remove oxygen from the furnace, and then evacuated to a pressure of about 0.10–0.01 torr. The temperature of the furnace was then raised to about 1700° C. and maintained for about 10 hours. After cooling, the surface of the carburized tantalum or tantalum alloy crucible was treated with an acid solution consisting of nitric acid (25% by volume), hydrofluoric acid (25% by volume), and lactic acid (50% by volume) by applying the acid solution to a swab and wiping the surface of the crucible with the swab.

Figure 1A:
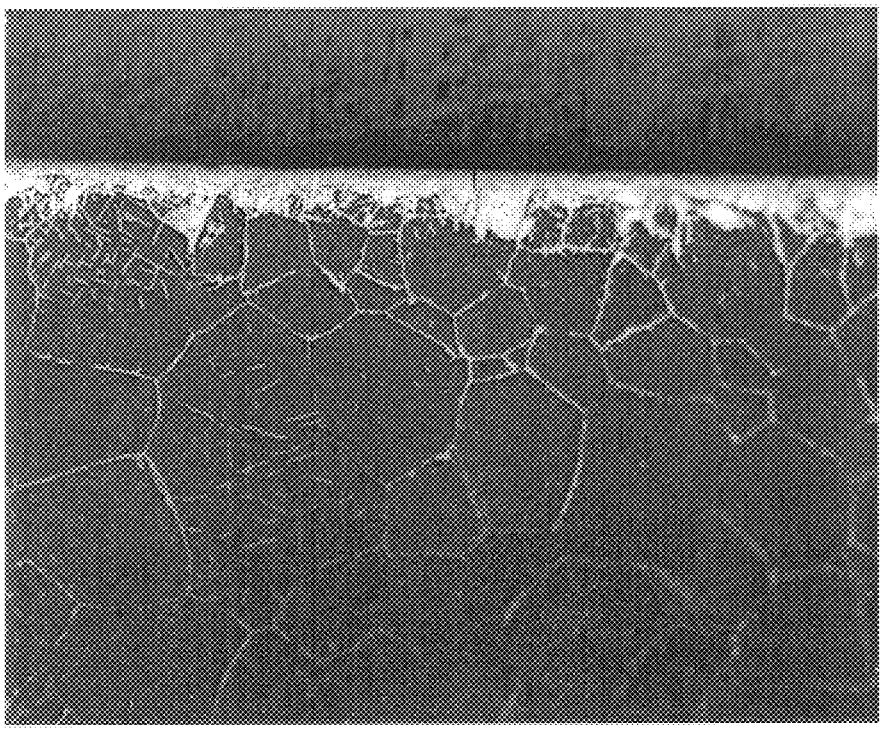
FIG. 1*a* shows a reflective light photomicrograph (×250) of a cross section of a tantalum crucible after carburization for 10 hours at 1700° C. The thin, topmost layer of the surface of the carburized crucible is a TaC layer, the thicker, middle lightly colored layer is a $Ta_2C$ layer, and the thickest, bottom layer is carburized tantalum which appears as a collection of grains having $Ta_2C$ along the grain boundaries. Additional $Ta_2C$ appears within the grains.

FIG. 1*a* shows a reflective light photomicrograph of a cross section of the tantalum crucible after carburizing for 10 hours at 1700° C. The surface of the tantalum crucible was found to be covered with a thin outermost layer of TaC and a thicker inner layer of $Ta_2C$. The carburized tantalum appears as a collection of grains separated by $Ta_2C$ along the grain boundaries.

Figure 1B:
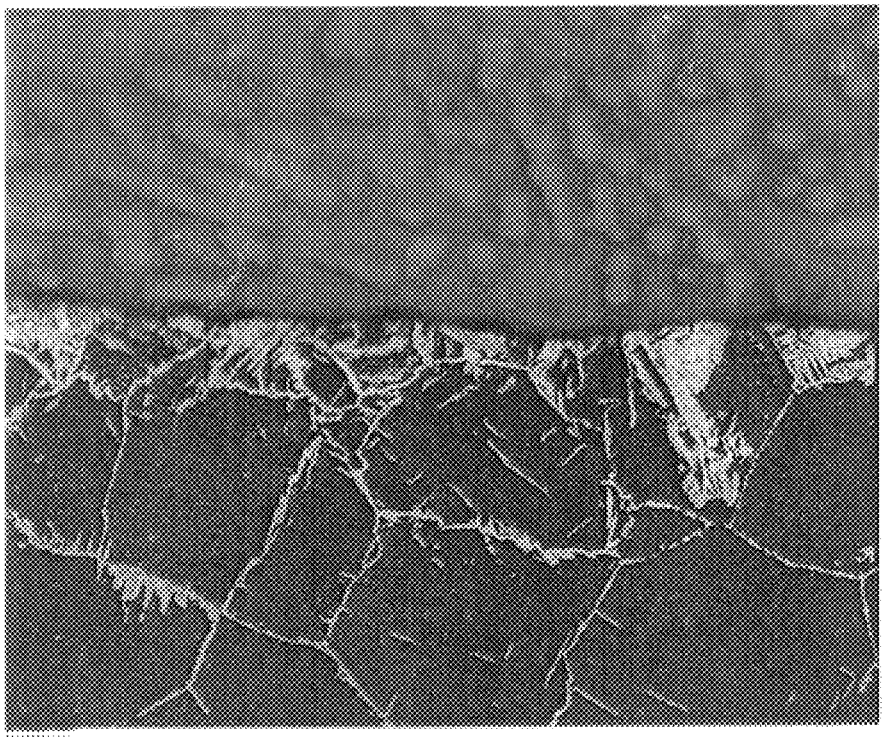
FIG. 1*b* shows a reflective light photomicrograph (×250) of a cross section of the tantalum crucible of FIG. 1*a* after applying the acid wash to the crucible surface. The acid wash successfully removed the TaC and $Ta_2C$ layers, but did not remove the $Ta_2C$ along the grain boundaries.

The surface of the carburized tantalum crucible shown in FIG. 1*a* was subsequently treated for about 15 minutes with the acid solution and then rinsed with water to remove the acid solution. The reflective light photomicrograph of a cross section of the acid treated component is shown in FIG. 1*b*. It reveals that the $Ta_2C$ coating was removed by the acid wash, while the $Ta_2C$ along the grain boundaries was unaffected. This is important, since the present inventors believe that the $Ta_2C$ located along the grain boundaries greatly enhances the corrosion resistance of the crucible toward corrosive liquids by not allowing the corrosive liquid to enter the carburized crucible along the grain boundaries and detach grains therefrom.

Figure 2A:
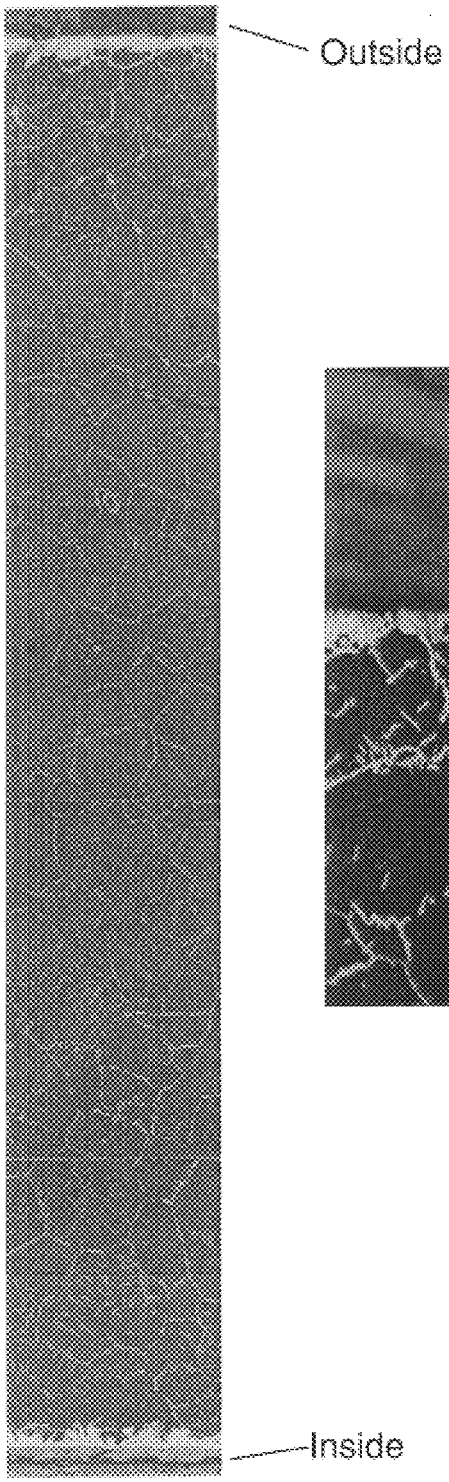
FIG. 2*a* shows a reflective light photomicrograph (×100) of a cross section of thin-walled (0.135 in.) tungsten alloy crucible made of 90% tantalum and 10% tungsten after carburization for 10 hours at 1700° C. The top portion of FIG. 2*a* shows the outside surface of the crucible and the bottom shows the inside surface of the crucible. The carburized tantalum alloy grains are separated by $Ta_2C$ along the grain boundaries. Additional $Ta_2C$ appears within the grains.

FIG. 2*a* shows a reflective light photomicrograph of a cross section of the tungsten alloy crucible (0.135 inches in thickness) after carburization for 10 hours at 1700° C. The top portion of FIG. 2*a* shows the outside of the crucible and the bottom portion shows the inside of the crucible. The carburized tantalum alloy grains are separated by $Ta_2C$ along the grain boundaries. FIG. 2*a* clearly shows $Ta_2C$ along the grain boundaries throughout the entire crucible. Additional $Ta_2C$ appear within the grains as confirmed by a standard microprobe analysis.

Figure 2B:
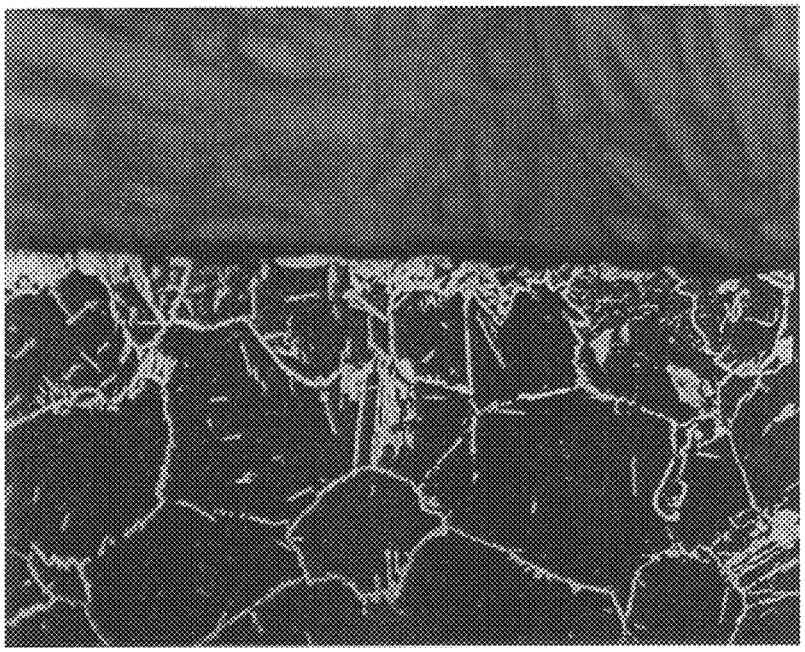
FIG. 2*b* shows a reflective photomicrograph (×250) of a cross section of the crucible of FIG. 2*a* after applying the acid wash to a crucible surface. The acid wash successfully removed the TaC and $Ta_2C$ layers, but did not remove the $Ta_2C$ along the grain boundaries.

FIG. 2*b* shows a reflective light photomicrograph of a cross section of the crucible of FIG. 2*a* after applying the acid wash to a crucible surface. The acid wash successfully removed the TaC and $Ta_2C$ layers but did not remove the $Ta_2C$ along the grain boundaries.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for carburizing a tantalum or tantalum alloy object, comprising the steps of:

a. placing at least one surface of the object in contact with a carburizing pack, thereby forming a packed object;

b. evacuating the volume around the packed object;

c. heating the object in the carburizing pack to a temperature whereby carbon from the pack diffuses into the object forming grains with tantalum carbide along the grain boundaries; and d. etching the at least one surface of the carburized object, thereby removing tantalum carbides from the at least one surface of the carburized object and leaving the tantalum carbide along the grain boundaries.

2. The method as recited in claim 1, further comprising polishing the at least one surface of the object to provide a uniformly clean surface prior to said step of placing at least one surface of the object in contact with a carburizing pack.

3. The method as recited in claim 1, wherein said step of etching is performed with an acid mixture comprising nitric acid, hydrofluoric acid, and lactic acid.

4. The method as recited in claim 3, wherein the acid mixture comprises by volume about 25% nitric acid, 25% hydrofluoric acid, and 50% lactic acid.

5. The method as recited in claim 1 wherein the carburizing pack consists of activated carbon powder.

6. The method as recited in claim 1, wherein said packed object is contained in a graphite crucible having a graphite cover.

* * * * *